US006842103B2

(12) United States Patent
Yoshinari et al.

(10) Patent No.: US 6,842,103 B2
(45) Date of Patent: Jan. 11, 2005

(54) ORGANIC PTC THERMISTOR

(75) Inventors: Yukie Yoshinari, Tokyo (JP); Tokuhiko Handa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/443,757

(22) Filed: May 23, 2003

(65) Prior Publication Data

US 2003/0218530 A1 Nov. 27, 2003

(30) Foreign Application Priority Data

May 24, 2002 (JP) ..... 2002-150220

(51) Int. Cl.[7] ..... H01C 7/10
(52) U.S. Cl. ..... 338/22 R; 338/22 SD
(58) Field of Search ..... 338/22 R, 22 SD

(56) References Cited

U.S. PATENT DOCUMENTS 4,910,389 A * 3/1990 Sherman et al. ..... 219/548
5,280,263 A * 1/1994 Sugaya ..... 338/22 R
5,378,407 A * 1/1995 Chandler et al. ..... 252/513
5,705,555 A * 1/1998 Guilfoy et al. ..... 524/495
5,925,276 A * 7/1999 Batliwalla et al. ..... 219/553
5,945,034 A * 8/1999 Handa et al. ..... 252/511
6,090,314 A * 7/2000 Handa et al. ..... 252/511
6,133,820 A * 10/2000 Duggal et al. ..... 338/22 R
6,143,206 A * 11/2000 Handa et al. ..... 252/500
6,299,801 B1 * 9/2002 Handa et al. ..... 252/511
6,452,476 B1 * 9/2002 Handa ..... 338/22 R
6,607,679 B2 * 8/2003 Handa et al. ..... 252/513

FOREIGN PATENT DOCUMENTS

JP 11-242812 9/1999
JP 2001167905 * 6/2001

OTHER PUBLICATIONS

English translation to Matsuo 2001167905 (Jun. 2001).*

* cited by examiner

*Primary Examiner*—Karl D. Easthom
(74) *Attorney, Agent, or Firm*—Oblon, Spivak, McClelland, Maier & Neustadt, P.C.

(57) ABSTRACT

In an organic PTC thermistor comprising a thermistor body comprising a high-molecular weight organic compound-containing matrix and metal particles, conductive non-metallic fines, typically carbon black, are attached to surfaces of the metal particles. The device has a low room-temperature resistance and a high change rate of resistance, and prevents degradation of its performance during storage under hot humid conditions.

23 Claims, 1 Drawing Sheet

ORGANIC PTC THERMISTOR

BACKGROUND OF THE INVENTION

1. Field of the Invention

This invention relates to an organic positive temperature coefficient thermistor that is used as a temperature sensor or overcurrent-protecting element, and has positive temperature coefficient (PTC) of resistivity characteristics that its resistance value increases with increasing temperature.

2. Background Art

An organic positive temperature coefficient thermistor having conductive particles dispersed in a crystalline polymer matrix is well known in the art, as disclosed in U.S. Pat. Nos. 3,243,753 and 3,351,882. The increase in the resistance value is believed to be due to the expansion of the crystalline polymer upon melting, which in turn cleaves a current-carrying path formed by the conductive particles linked together.

An organic PTC thermistor can be used as an overcurrent or overheat-protecting element, a self-regulating heater, and a temperature sensor. The characteristics which are required by these elements include a sufficiently low resistance value at room temperature in a quiescent state, a sufficiently high rate of change between the room-temperature resistance value and the resistance value in operation, and a minimal change of resistance upon repeated operation.

Electrically conductive particles used in organic PTC thermistors are typically carbonaceous particles such as carbon black and graphite. In order to reduce the resistance in a quiescent state of the thermistor, a large amount of carbonaceous particles must be dispersed in the matrix. This makes it difficult to increase the rate of resistance change, failing to provide satisfactory characteristics for protecting overcurrent or overheating.

This drawback can be overcome using metal particles having a lower resistivity than carbonaceous particles. For instance, the inventors proposed in JP-A 10-214705 and JP-A 11-168005 that the use of metal particles having spiky protuberances can find a compromise between a low room-temperature resistance and a high resistance change rate.

However, the inventors found that these organic PTC thermistors using metal particles lack reliability in that the room-temperature resistance increases during storage under severe conditions including a high temperature and a high humidity. Presumably the reasons why characteristics degrade during storage are that metal particles are oxidized on their surface to reduce their conductivity, that more metal particles agglomerate to break some conductive paths, and the like.

SUMMARY OF THE INVENTION

An object of the invention is to provide an organic PTC thermistor which is endowed with a low room-temperature resistance and a sufficiently high change rate of resistance using metal particles as conductive particles, and which restrains its performance from being degraded during storage under severe conditions of high temperature and high humidity.

The present invention provides an organic positive temperature coefficient (PTC) thermistor comprising a thermistor body comprising a high-molecular weight organic compound-containing matrix and metal particles, wherein a non-metallic powder of electrically conductive non-metallic fines attaches to surfaces of the metal particles.

The non-metallic powder is preferably present in a range of 0.1% to 10% by weight based on the weight of the entire metal particles. The non-metallic powder is typically carbon black. Preferably the metal particles have spiky protuberances.

The organic PTC thermistor of the invention has a thermistor body comprising an organic material-base matrix having dispersed therein metal particles as electrically conductive particles.

In the thermistor body according to the invention, a non-metallic powder composed of non-metallic fines having conductivity is present so as to cover surfaces of the metal particles. The coverage of metal particle surfaces with non-metallic fines prevents surface oxidation of metal particles, thus restraining the characteristics from being degraded during storage, especially under high temperature, high humidity conditions. In addition, since the non-metallic fines are conductive, the advantages inherent to the use of metal particles including a low room-temperature resistance and a high resistance change rate are not impaired. Therefore, the invention is successful in providing an organic PTC thermistor having a low room-temperature resistance, a high resistance change rate and high reliability.

As the size of metal particles becomes smaller, there are more contact points between metal particles in the thermistor body. For this reason, reducing the size of metal particles is not only effective for lowering the room-temperature resistance without increasing the loading of metal particles in the thermistor body, but also increases the probability that metal particles are located closer to each other during cooling after thermistor operation, leading to the advantage of easy restoration of resistance to the original. However, metal particles of smaller size are more likely to agglomerate together and less wettable by an organic material as the matrix and as a consequence, difficult to uniformly disperse in the matrix. Accordingly, the use of smaller metal particles often results in more variations of room-temperature resistance and imposes difficulties to the mass production of thermistors having consistent performance. In contrast, metal particles which are surface covered with non-metallic fines as specified above are less likely to agglomerate together and more wettable by an organic material. This concept permits the use of smaller metal particles and enables the mass production of thermistors having consistent performance.

When an organic PTC thermistor is repeatedly exposed to thermal shocks, the matrix undergoes repeated cycles of expansion and contraction, which makes unstable the interface between the matrix and metal particles, leading to degradation of thermistor properties, especially an increase of room-temperature resistance. In this regard, when metal particles are covered with non-metallic fines, the wettability of metal particles is improved so that the increase of room-temperature resistance due to repeated thermal shocks is suppressed.

A further advantage of the invention is the ease of manufacture of a thermistor body. A metal powder of metal particles, especially having spiky protuberances is bulky and has a low bulk density. While the loading density of metal particles in the thermistor body must be increased in order to lower the room-temperature resistance, it is difficult to compound a bulky metal powder and a matrix material to form a homogeneous blend. In contrast, a powder of metal particles covered with non-metallic fines has a higher bulk density than a powder of bare metallic particles. For instance, a metal powder of metal particles having spiky protuberances commercially available under the trade name of INCO Type 210 from INCO Ltd. has a bulk density of about 0.8 g/cm$^3$ while the coverage of the metal particles with non-metallic fines increases the bulk density to 1.909 g/cm$^3$. Therefore, the coverage of metal particles with non-metallic fines provides both improved wettability and an increased bulk density, which facilitates compounding of metal particles with a matrix material to form a homogeneous blend. This enables easy and consistent manufacture of thermistors having a low room-temperature resistance and a minimized variation thereof.

According to the invention, an organic PTC thermistor is established having a sufficiently low room-temperature resistance, a sufficiently high change rate of resistance during operation, a minimized performance variation, and improved stability of thermistor performance over time. The organic PTC thermistor of the invention exhibits a low resistivity of about $10^{-4}$ to about $10^{-2}$ Ω-cm at room temperature, a sharp rise of resistance during operation, and a change of resistance equal to or greater than 6 orders of magnitude between quiescent and operative states.

DESCRIPTION OF THE PREFERRED EMBODIMENT

Figure 1:
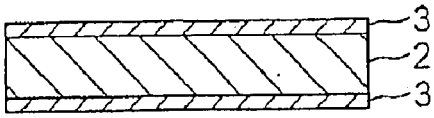
FIG. 1 is a cross-sectional view of an organic PTC thermistor according to one embodiment of the invention.

Referring to FIG. 1, there is illustrated an organic PTC thermistor according to one embodiment of the invention. The organic PTC thermistor includes a thermistor body 2 sandwiched between a pair of electrodes 3. The illustrated embodiment illustrates one exemplary cross-sectional shape of the thermistor, and various modifications may be made without departing from the scope of the invention. The planar shape of the thermistor may be a circular, square, rectangular or any appropriate shape depending on the desired characteristics and specifications.

In the invention, the thermistor body 2 includes a high-molecular weight organic compound-containing matrix and metal particles dispersed therein. A non-metallic powder of conductive non-metallic fines attaches to surfaces of the metal particles.

Described below are the construction and production of the respective components of the inventive thermistor.

Metal Particles

The metal particles to be dispersed in the matrix or thermistor body are typically of copper, aluminum, nickel, tungsten, molybdenum, silver, zinc, cobalt or the like, with nickel and copper being preferred.

The shape of metal particles may be spherical, flake, rod or the like. Particles having spiky protuberances on their surface are especially preferred. Presumably such a protuberant surface contour allows for conduction of tunneling current flow and can reduce the room-temperature resistance as compared with smooth spherical metal particles. Also the space between adjacent protuberant metal particles in the matrix is larger than the space between adjacent smooth spherical metal particles, contributing to a greater resistance change rate.

The metal particles having spiky protuberances as used herein are made up of primary particles each having pointed protuberances. More preferably, one particle bears a plurality of, usually 10 to 500, conical and spiky protuberances having a height of ⅓ to 1/50 of the particle diameter. The metal particles may be used in a powder form consisting of discrete particles. It is preferable that about 10 to about 1,000 primary particles be interconnected in chain-like network to form a secondary particle. A mixture of chain-like secondary particles and discrete primary particles is also acceptable.

An exemplary powder consisting of discrete primary particles is a powder of spherical nickel particles having spiky protuberances, which is commercially available under the trade name of INCO Type 123 Nickel Powder (INCO Ltd.). The powder has an average particle diameter of about 3 to 7 μm, a bulk density of about 1.8 to 2.7 g/cm$^3$, and a specific surface area of about 0.34 to 0.44 m$^2$/g.

Preferred examples of the powder based on secondary particles are filamentary nickel powders, which are commercially available under the trade name of INCO Type 210, 255, 270 and 287 Nickel Powders from INCO Ltd. Of these, INCO Type 210 and 255 Nickel Powders are preferred. The primary particles therein preferably have an average particle diameter of preferably at least 0.1 μm, and more preferably from about 0.2 to about 4.0 μm. Most preferred are primary particles having an average particle diameter of 0.5 to 3.0 μm, in which may be mixed up to 50% by weight of primary particles having an average particle diameter of 0.1 μm to less than 0.4 μm. The bulk density is about 0.3 to 1.0 g/cm$^3$ and the specific surface area is about 0.4 to 2.5 m$^2$/g. As described previously, the present invention becomes more effective when metal particles have a smaller average particle diameter. In this context, a filamentary nickel powder having a average primary particle diameter in a range of 0.1 to 3 μm is especially effective.

It is to be noted that the average particle diameter is measured by the Fischer sub-sieve method.

Such metal particles are set forth in JP-A 5-47503 and U.S. Pat. No. 5,378,407, which are incorporated herein by reference.

The content of metal particles in the thermistor body should preferably be 25 to 50% by volume. Too low a content of metal particles may make it difficult to provide a sufficiently low room-temperature resistance in a quiescent state. Too high a content of metal particles, on the contrary, may make it difficult to obtain a high rate of resistance change and to achieve uniform dispersion of metal particles in the matrix, failing to provide stable properties.

Non-metallic Fines

The non-metallic powder deposited so as to cover surfaces of metal particles is composed of conductive non-metallic fines.

The conductive non-metallic fines are preferably of carbon black, especially channel black or furnace black or both. These carbon blacks are commercially available. Commercial products include #3050, #3150, #3250, #3750, #3950, MA100, MA7, #1000, #2400B, #30, MA77, MA8, #650, MA11, #50, #52, #45, #2200B and MA600 from Mitsubishi Chemical Corp. and Seast 9H, Seast 7H, Seast 6, Seast 3H, Seast 300 and Seast FM from Tokai Carbon Co., Ltd.

The average particle diameter of non-metallic fines may be determined as appropriate to achieve the desired effects. The average particle diameter is typically 2 to 50 nm, and especially 2 to 35 nm. Fines with too small an average diameter may be difficult to handle. Fines with too large an average diameter may be difficult to attach to surfaces of metal particles by the method to be described later, failing to achieve the desired effects.

The buildup of non-metallic fines on the metal particles is preferably 0.1% to 10% by weight, more preferably 0.1% to 5% by weight based on the weight of the metal particles. Too small a buildup of non-metallic fines often fails to achieve the desired effects. Too large a buildup of non-metallic fines will leave more non-metallic fines unattached to metal particle surfaces. That is, more non-metallic fines will be left free or independent in the thermistor body, negating the advantages inherent to the use of metal particles including a low room-temperature resistance and a high resistance change rate during current-limiting operation.

The non-metallic fines cover at least in part, preferably in entirety, the surface of each metal particle. Preferably the non-metallic fines cover the metal particle surface to form thereon a layer having a thickness in the range of 0.1 to 100 nm, more preferably 1 to 50 nm.

Any desired method may be employed for covering surfaces of metal particles with non-metallic fines as long as the desired effects are achieved. Preferably, an adhesive layer is formed on surfaces of metal particles whereby non-metallic fines are affixed thereto. To this end, the method described in JP-A 11-242812 can be utilized. In a typical procedure, metal particles and an alkoxysilane solution are thoroughly mixed, then non-metallic fines are added to the dispersion and thoroughly mixed therewith. This is followed by drying, yielding metal particles having a coating of organosilane compound to which non-metallic fines are affixed.

Examples of the alkoxysilane used in the procedure include methyltriethoxysilane, methyltrimethoxysilane, dimethyldimethoxysilane, dimethyldiethoxysilane, isobutyltrimethoxysilane, and phenyltriethoxysilane. High-molecular weight organic compound (matrix)

The matrix is composed solely or mainly of a high-molecular weight organic compound (or organic polymer). The high-molecular weight organic compound may be either thermoplastic or thermosetting, preferably thermoplastic.

Suitable thermoplastic polymers used as the matrix include polyolefins (e.g., polyethylene), olefin polymers (e.g., ethylene-vinyl acetate copolymers, ethylene-acrylic acid copolymers), halogenated polymers, polyamides, polystyrene, polyacrylonitrile, polyethylene oxide, polyacetal, thermoplastic modified celluloses, polysulfones, thermoplastic polyesters (e.g., PET), poly(ethyl acrylate), and poly(methyl methacrylate).

Illustrative examples include high-density polyethylene (e.g., trade name HI-ZEX 2100JP from Mitsui Chemicals, Inc., Marlex 6003 by Philips, and HY540 by Japan Polychem Corp.), low-density polyethylene (e.g., trade name LC500 by Japan Polychem Corp. and DYNH-1 by Union Carbide), medium-density polyethylene (e.g., trade name 2604M by Gulf), ethylene-ethyl acrylate copolymers (e.g., trade name DPD6169 by Union Carbide), ethylene-vinyl acetate copolymers (e.g., trade name LV241 by Japan Polychem Corp.), ethylene-acrylic acid copolymers (e.g., trade name EAA455 by Dow Chemical), ionomer resins (e.g., trade name Himilan 1555 by Dupont-Mitsui Polychemicals Co., Ltd.), poly(vinylidene fluoride) (e.g., trade name Kynar 461 by Elf Atochem), and vinylidene fluoride-tetrafluoroethylene-hexafluoropropylene copolymers (e.g., trade name Kynar ADS by Elf Atochem).

Of these, polyolefins are preferred, with polyethylene being especially preferred. Various grades of polyethylene including high-density, linear low-density and low-density grades are useful, with the high-density and linear low-density polyethylenes being preferred.

The thermoplastic polymer used herein is preferably a crystalline polymer synthesized in the presence of a metallocene catalyst, that is, a catalyst based on a metallocene of an organometallic compound. The use of such crystalline polymer ensures temperature performance having a minimized hysteresis during heating and cooling cycles.

The metallocene catalyst used herein is a bis (cyclopentadienyl) metal complex catalyst belonging to the class of sandwich molecules. In general, the metallocene catalysts include (a) metallocene catalyst components consisting of transition metal compounds of Group 4, 5 or 6 in the Periodic Table having at least one ligand having a cyclopentadienyl skeleton, (b) organoaluminum oxy compound catalyst components, (c) microparticulate carriers, and optionally, (d) organoaluminum compound catalyst components and (e) ionized ionic compound catalyst components.

The preferred metallocene catalyst components (a) used herein are transition metal compounds of Group 4, 5 or 6 in the Periodic Table having at least one ligand having a cyclopentadienyl skeleton. The transition metal compounds are, for example, those of the following general formula [I].

$$ML1_x \quad [I]$$

Herein, x is the valence of a transition metal atom M. M is a transition metal atom, preferably selected from Group 4 in the Periodic Table, for example, zirconium, titanium, and hafnium, and most preferably, zirconium and titanium.

L1 stands for ligands which coordinate to the transition metal atom M. Of these, at least one ligand L1 is a ligand having a cyclopentadienyl skeleton. Examples of the ligand L1 having a cyclopentadienyl skeleton that coordinates to the transition metal atom M include alkyl-substituted cyclopentadienyl groups such as cyclopentadienyl, as well as indenyl, 4,5,6,7-tetrahydroindenyl, and fluorenyl groups. These groups may be substituted with halogen atoms, trialkylsilyl groups or the like.

Where the compound of the above general formula [I] contains two or more groups having a cyclopentadienyl skeleton, two of these groups having a cyclopentadienyl skeleton may be bound through an alkylene group such as ethylene or propylene, a silylene group or a substituted silylene group such as dimethylsilylene, diphenylsilylene or methylphenylsilylene.

Preferred as the organoaluminum oxy compound catalyst components (b) are aluminooxanes. Examples are those having about 3 to about 50 recurring units represented by the formula: —Al(R)O— wherein R is an alkyl, such as methyl aluminooxane, ethyl aluminooxane and methyl ethyl aluminooxane. Not only chain-like compounds, but cyclic compounds are also employable.

The microparticulate carriers (c) used in the preparation of olefin polymerization catalysts are granular or microparticulate solids of inorganic or organic compounds having a particle diameter of usually about 10 to 300 $\mu$m, preferably about 20 to 200 $\mu$m.

Preferred inorganic carriers are porous oxides, for example, $SiO_2$, $Al_2O_3$, MgO, $ZrO_2$, and $TiO_2$. The organoaluminum compound catalyst components (d) used in the preparation of olefin polymerization catalysts are exemplified by trialkylaluminums such as trimethylaluminum, dialkylaluminum halides such as dimethylaluminum chloride, and alkylaluminum sesquihalides such as methylaluminum sesquichloride.

The ionized ionic compound catalyst components (e) include, for example, Lewis acids such as triphenylboron, $MgCl_2$, $Al_2O_3$, and $SiO_2$—$Al_2O_3$ as described in U.S. Pat. No. 5,321,106; ionic compounds such as triphenylcarbonium tetrakis(pentafluorophenyl)borate; and carborane compounds such as dodecarborane and bis-n-butylammonium (1-carbododeca)borate.

In preparing thermoplastic polymers using the above-described metallocene catalyst, monomers are polymerized in the presence of the catalyst in a vapor phase or a liquid phase (slurry or solution form).

Thermoplastic polymers prepared using the metallocene catalyst include ethylene polymers (e.g., homopolymers of ethylene, copolymers of ethylene with α-olefins having about 3 to about 20 carbon atoms or cyclic olefins, homopolymers of propylene, and copolymers of propylene with α-olefins) and styrene polymers. Of these, ethylene polymers are preferred, and linear low-density polyethylenes (LLDPE) which are copolymers of ethylene with α-olefins are especially preferred.

The linear low-density polyethylenes are preferably obtained by copolymerizing ethylene with α-olefins having 3 to 20 carbon atoms. Examples of suitable α-olefins include propylene, 1-butene, 1-pentene, 1-hexene, 4-methyl-1-pentene, 1-octene, 1-decene, and 1-dodecene. Of these, α-olefins having 4 to 10 carbon atoms, especially α-olefins having 4 to 8 carbon atoms are preferred. Such α-olefins may be used alone or in admixture of two or more.

It is desirable that the linear low-density polyethylenes used herein contain from 50% to less than 100% by weight, preferably 75 to 99% by weight, more preferably 80 to 95% by weight, most preferably 85 to 95% by weight of constituent units derived from ethylene and up to 50% by weight, preferably 1 to 25% by weight, more preferably 5 to 20% by weight, most preferably 5 to 15% by weight of constituent units derived from α-olefins having 3 to 20 carbon atoms. The linear low-density polyethylenes used herein preferably have a density in the range of 0.900 to 0.940 g/cm$^3$, and more preferably 0.910 to 0.930 g/cm$^3$. Also, the linear low-density polyethylenes used herein preferably have a melt flow rate (MFR, ASTM D1238, 190° C., load 2.16 kg) in the range of 0.05 to 20 g/10 min, and more preferably 0.1 to 10 g/10 min. The linear low-density polyethylenes used herein should preferably have a narrow molecular weight distribution, and the Mw/Mn as an index of molecular weight distribution is preferably up to 6, more preferably up to 4. It is noted that Mw is a weight average molecular weight and Mn is a number average molecular weight, both measured by gel permeation chromatography (GPC). The number of long-chain branches on the linear low-density polyethylenes used herein is preferably up to 5 carbons per 1000 backbone carbons and more preferably up to 1 carbon per 1000 backbone carbons. The number of long-chain branches is measured by $^{13}$C-NMR.

Low-Molecular Weight Organic Compound (Matrix)

A low-molecular weight organic compound may be included in the matrix. Ordinary organic PTC thermistors operate (i.e., increase their resistance) by way of expansion of the high-molecular weight organic compound matrix as the temperature rises. In the case of crystalline polymers, their melting point and hence, the operating temperature can be varied by altering their molecular weight or degree of crystallization or by copolymerizing with comonomers, but with a concomitant change of crystalline state which can lead to unsatisfactory PTC characteristics. This problem becomes more outstanding when the operating temperature is set at 100° C. or lower. In contrast, the use of a high-molecular weight organic compound in combination with a low-molecular weight organic compound having a different melting point enables easy control of the operating temperature without adverse impact on the PTC characteristics.

Since a low-molecular weight organic compound generally has a higher degree of crystallization than high-molecular weight organic compounds, the inclusion of low-molecular weight organic compound permits a sharper rise of resistance upon heating.

Although high-molecular weight organic compounds, which are likely to take a supercooled state, exhibit a hysteresis phenomenon that the temperature at which the original resistance is resumed upon cooling is lower than the operating temperature upon heating, the use of low-molecular weight organic compound alleviates the hysteresis.

The low-molecular weight organic compound used herein is not critical as long as it is a crystalline substance having a molecular weight of less than about 2,000, preferably less than about 1,000, and more preferably about 200 to 800. Preferably it is solid at room temperature (about 25° C.).

When it is desired to obtain an organic PTC thermistor having an operating temperature of up to 200° C., more preferably up to 100° C., the melting point of low-molecular weight organic compound should preferably be in the range of 40° C. to 200° C., more preferably in the range of 40° C. to 100° C.

Suitable low-molecular weight organic compounds include waxes, oils and fats, with petroleum waxes being preferred. Suitable waxes include, for example, petroleum waxes such as paraffin wax and microcrystalline wax, and natural waxes such as vegetable waxes, animal waxes and mineral waxes. Suitable oils and fats include, for example, those known as fat or solid fat. Waxes, oils and fats contain such components as hydrocarbons (e.g., alkane series straight-chain hydrocarbons having 22 or more carbon atoms), fatty acids (e.g., fatty acids of alkane series straight-chain hydrocarbons having 12 or more carbon atoms), fatty esters (e.g., methyl esters of saturated fatty acids obtained from saturated fatty acids having 20 or more carbon atoms and lower alcohols such as methyl alcohol), fatty acid amides (e.g., unsaturated fatty acid amides such as oleic acid amide and erucic acid amide), aliphatic amines (e.g., aliphatic primary amines having 16 or more carbon atoms), higher alcohols (e.g., n-alkyl alcohols having 16 or more carbon atoms), and chlorinated paraffin. These low-molecular weight compounds are commercially available and such commercial products are ready for use.

The low-molecular weight organic compound used herein should preferably have a melting point (mp) of 40 to 200° C., more preferably 40 to 100° C. Such low-molecular weight organic compounds, for instance, include paraffin waxes such as tetracosane $C_{24}H_{50}$ (mp 49–52° C.), hexatriacontane $C_{36}H_{74}$ (mp 73° C.) under the trade name HNP-10 (mp 75° C.) and HNP-3 (mp 66° C.) from Nippon Seiro Co., Ltd.; microcrystalline waxes such as Hi-Mic 1080 (mp 83° C.), Hi-Mic 1045 (mp 70° C.), Hi-Mic 2045 (mp 64° C.) and Hi-Mic 3090 (mp 89° C.), all from Nippon Seiro Co., Ltd., Celata 104 (mp 96° C.) and 155 Micro-Wax (mp 70° C.), both from Nippon Petroleum Refining Co., Ltd.; fatty acids such as behenic acid (mp 81° C.), stearic acid (mp 72° C.) and palmitic acid (mp 64° C.), all from Nippon Seika Co., Ltd.; fatty acid esters such as methyl arachidate (mp 48° C.) from Tokyo Kasei Co., Ltd.; and fatty acid amides, for example, oleic acid amide (mp 76° C.) from Nippon Seika Co., Ltd. Also included are polyethylene waxes such as Mitsui Hiwax 110 (mp 100° C.) from Mitsui Chemical Co., Ltd.; stearic acid amide (mp 109° C.), behenic acid amide (mp 111° C.), N,N'-ethylene-bislauric acid amide (mp 157° C.), N,N'-dioleyladipic acid amide (mp 119° C.), and N,N'-hexamethylenebis-12-hydroxystearic acid amide (mp 140° C.). Use may also be made of wax blends of a paraffin wax with a resin and such wax blends having microcrystalline wax further blended therein so as to give a melting point of 40° C. to 200° C.

The low-molecular weight organic compounds may be used alone or in combination of two or more. An appropriate low-molecular weight organic compound is selected in accordance with the polarity of a high-molecular weight organic compound to be combined therewith so that the respective components become more dispersible.

An appropriate weight of the low-molecular weight organic compound in the matrix is 0.05 to 4 times, preferably 0.1 to 2.5 times the weight of the high-molecular weight organic compound. If the content of the low-molecular weight organic compound becomes low, it may fail to provide a satisfactory resistance change rate. Inversely, if the content of the low-molecular weight organic compound becomes high, the thermistor body can be substantially deformed due to melting of the low-molecular weight organic compound and it may become awkward to mix with metal particles.

When analyzed by differential scanning calorimetry (DSC), the thermistor body containing a high-molecular weight organic compound and a low-molecular weight organic compound develops endothermic peaks near the melting points of the high-molecular weight organic compound and the low-molecular weight organic compound. This suggests an island-in-sea structure that the high-molecular weight organic compound and the low-molecular weight organic compound are independently dispersed.

Miscellaneous

In the thermistor body, additional materials are included, if necessary or desired, in addition to the matrix and the non-metallic fine-coated metal particles.

For instance, there may be added a good heat transfer additive, for example, silicon nitride, silica, alumina and clay (mica, talc, etc.) as described in JP-A 57-12061, silicon, silicon carbide, silicon nitride, beryllia and selenium as described in JP-B 7-77161, inorganic nitrides and magnesium oxide as described in JP-A 5-217711.

For durability improvements, there may be added titanium oxide, iron oxide, zinc oxide, silica, magnesium oxide, alumina, chromium oxide, barium sulfate, calcium carbonate, calcium hydroxide and lead oxide as described in JP-A 5-226112, and inorganic solids having a high relative permittivity such as barium titanate, strontium titanate and potassium niobate as described in JP-A 6-68963.

For withstand voltage improvements, boron carbide and analogues as described in JP-A 4-74383 may be added.

For strength improvements, there may be added hydrated alkali titanates as described in JP-A 5-74603, and titanium oxide, iron oxide, zinc oxide and silica as described in JP-A 8-17563.

There may be added a crystal nucleator, for example, alkali halides and melamine resin as described in JP-B 59-10553, benzoic acid, dibenzylidenesorbitol and metal benzoates as described in JP-A 6-76511, talc, zeolite and dibenzylidenesorbitol as described in JP-A 7-6864, and sorbitol derivatives (gelling agents), asphalt and sodium bis(4-t-butylphenyl) phosphate as described in JP-A 7-263127.

As an arc-controlling agent, there may be added alumina and magnesia hydrate as described in JP-B 4-28744, metal hydrates and silicon carbide as described in JP-A 61-250058.

For preventing the harmful effects of metals, there may be added Irganox MD1024 (Ciba-Geigy) as described in JP-A 7-6864, etc.

As a flame retardant, there may be added diantimony trioxide and aluminum hydroxide as described in JP-A 61-239581, magnesium hydroxide as described in JP-A 5-74603, as well as halogen-containing organic compounds (including polymers) such as 2,2-bis(4-hydroxy-3,5-dibromophenyl)propane and polyvinylidene fluoride (PVDF) and phosphorus compounds such as ammonium phosphate.

Besides, there may be added zinc sulfide, basic magnesium carbonate, aluminum oxide, calcium silicate, magnesium silicate, aluminosilicate clay (mica, talc, kaolinite, montmorillonite, etc.), glass powder, glass flakes, glass fibers, calcium sulfate, etc.

The above additives should preferably be used in an amount of up to 25% by weight based on the total weight of the matrix and metal particles.

Preparation Method

Described below is one exemplary method for preparing the organic PTC thermistor of the invention.

First, metal particles are surface coated with a non-metallic powder, for example, by the aforementioned procedure. Then the coated metal particles are compounded or kneaded with a matrix material to disperse the particles in the matrix. By any well-known technique, kneading may be carried out at a temperature higher than the melting point of the high-molecular weight organic compound as the matrix, preferably higher by 5 to 40° C., and for a period of about 5 to 90 minutes. In the event where a low-molecular weight organic compound is additionally used, the high and low-molecular weight organic compounds may be previously melt mixed or dissolved in a solvent and mixed. For kneading, any desired mixing apparatus such as an agitator, dispersing machine, mill or paint roll mill may be used. If air is introduced during the mixing step, the mixture is vacuum deaerated. Various solvents such as aromatic hydrocarbons, ketones, and alcohols may be used for viscosity adjustment. To prevent thermal degradation of the high and low-molecular weight organic compounds, an antioxidant such as a phenol, organic sulfur or phosphite may also be incorporated.

If desired, crosslinking treatment may be conducted on the resulting mixture. Suitable crosslinking techniques include chemical crosslinking with organic peroxides, radiation crosslinking, and silane crosslinking including grafting of silane coupling agents and condensation reaction of silanol groups in the presence of water. The crosslinking by exposure to radiation such as electron beams may be carried out after the formation of electrodes.

The kneaded mixture is then press molded into a sheet. Electrodes are formed on opposite surfaces of the sheet. The electrodes may be formed by heat pressing a metal plate of Ni, Cu, etc. or by applying an electrically conductive paste. Finally, the electrode-bearing sheet is punched into a desired shape, obtaining a thermistor device.

EXAMPLE

Examples of the invention are given below by way of illustration and not by way of limitation.

Example 1

There were furnished a linear low-density polyethylene synthesized in vapor phase in the presence of a metallocene catalyst (trade name Evolue SP2520 by Mitsui Chemicals, Inc., MFR 1.7 g/10 min, mp 121° C.) as the high-molecular weight organic compound; a paraffin wax (trade name Poly Wax 655 by Baker Petrolite, mp 99° C.) as the low-molecular weight organic compound; a filamentary nickel powder (trade name Type 210 Nickel Powder by INCO Ltd., average particle diameter 0.5–1.0 $\mu$m, bulk density approx.

0.8 g/cm$^3$, specific surface area 1.5–2.5 m$^2$/g) as the metal powder; and carbon black (trade name MA100 by Mitsubishi Chemical Corp., average particle diameter approx. 22 nm) as the non-metallic powder.

Figure 2:
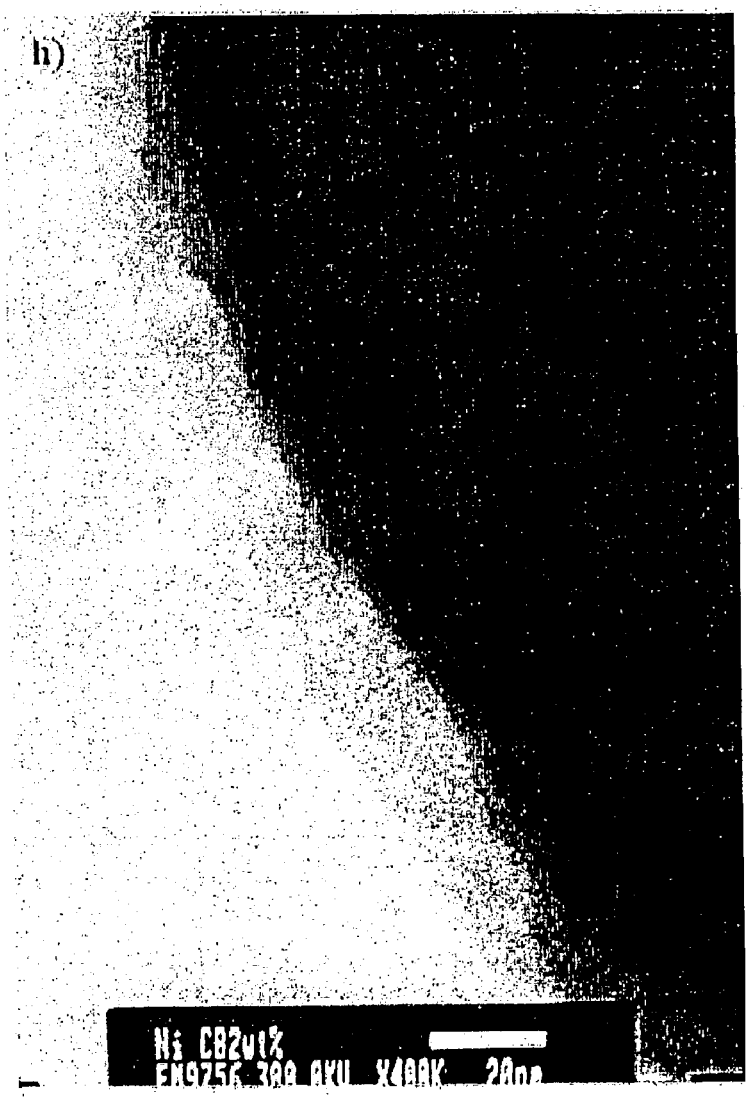
FIG. 2 is a TEM photomicrograph of a nickel particle covered with carbon black.

First, the metal particles were thoroughly mixed with an alkoxysilane solution in accordance with the procedure described in JP-A 11-242812. The non-metallic powder was added to the dispersion and thoroughly mixed. Drying yielded metal particles surface-covered with the non-metallic fines. The buildup of non-metallic fines was 2% by weight of the metal particles. FIG. 2 is a photomicrograph under transmission electron microscope of a metal particle covered with non-metallic fines. In FIG. 2, the region of high density denotes the metal particle and the region of low density surrounding the high density region denotes a non-metallic coating layer of carbon black. The non-metallic coating layer had a thickness of about 10 to 20 nm.

Next, 57% by volume of the high-molecular weight organic compound, 8% by volume of the low-molecular weight organic compound and 35% by volume of the non-metallic fine-covered metal powder were kneaded in a mill at 150° C. for 30 minutes.

The milled mixture was pressed at 150° C. into a sheet of 0.7 mm thick by means of a heat pressing machine. The sheet on opposite surfaces was sandwiched between a pair of Ni foil electrodes of about 30 $\mu$m thick. The assembly was heat pressed at 150° C. to a total thickness of 0.4 mm by means of a heat press. Electron beams were irradiated to the assembly for crosslinking. The assembly was then punched into a rectangular piece of 3.6 mm×9.0 mm, obtaining an organic PTC thermistor device.

The device was heated and cooled between room temperature (25° C.) and 120° C. at a rate of 2° C./min in a thermostat chamber. During the thermal cycling, a resistance value was measured at predetermined temperatures by the four-terminal method, from which a temperature vs. resistance curve was depicted.

The initial resistance at room temperature was $1.0\times10^{-3}\Omega$ (resistivity $8.1\times10^{-3}$ Ω-cm). The resistance marked a sharp rise at a temperature near 90° C., with the resistance change being of about 10 orders of magnitude. These demonstrated a low room-temperature resistance and a high resistance change rate. The resistance after cooling to room temperature was $2.0\times10^{-3}\Omega$ (resistivity $1.6\times10^{-2}$ Ω-cm), which was substantially unchanged from the room-temperature resistance prior to heating, indicating a satisfactory resistance resuming ability. Variations of initial resistance at room temperature were examined. Of ten samples, eight samples had a resistance of $1.0\times10^{-3}\Omega$ and two samples had a resistance of $1.5\times10^{-3}\Omega$, indicating a minimized variation.

This device was subjected to a hot humid storage test of holding at 60° C. and RH 95%. After 1,000 hours of storage, the device had a resistance at room temperature of $1.0\times10^{-3}\Omega$, indicating no degradation of performance during the hot humid storage. Variations of initial resistance at room temperature after 1,000 hours of storage were examined. Of ten samples, nine samples had a resistance of $1.0\times10^{-3}\Omega$ and one sample had a resistance of $1.5\times10^{-3}\Omega$, indicating substantially no increase of variation during the hot humid storage.

Also the device was subjected to a thermal shock test by repeating 200 thermal cycles of holding at −40° C. for 30 minutes and then holding at 85° C. for 30 minutes. An initial resistance at room temperature of $8.0\times10^{-2}\Omega$ was measured, indicating minimized degradation of performance by the thermal shock test.

Comparative Example 1

A thermistor device was fabricated as in Example 1 aside from using a powder of bare metal particles (not coated with non-metallic fines). The device was similarly tested.

The initial resistance at room temperature was $1.5\times10^{-3}\Omega$ (resistivity $1.2\times10^{-2}$ Ω-cm). The resistance marked a sharp rise at a temperature near 90° C., with the resistance change being of about 10 orders of magnitude. These demonstrated a low room-temperature resistance and a high resistance change rate.

With respect to variations of initial resistance at room temperature, of ten samples, four samples had a resistance of $1.5\times10^{-3}\Omega$, one sample $5.0\times10^{-3}\Omega$, three samples $7.0\times10^{-3}\Omega$, and two samples $1.5\times10^{-2}\Omega$, indicating a larger variation than in Example 1.

After a hot humid storage test of holding at 60° C. and RH 95% for 1,000 hours, the device had a resistance at room temperature of $2.0\times10^{-2}\Omega$, indicating noticeable degradation of performance during the hot humid storage. With respect to variations of initial resistance at room temperature after 1,000 hours of storage, of ten samples, five samples had a resistance of $2.0\times10^{-2}\Omega$, two samples $3.0\times10^{-2}\Omega$, and three samples $1.5\times10^{-2}\Omega$, indicating increased variations during the hot humid storage.

The initial resistance at room temperature after the thermal shock test was 30Ω, indicating noticeable degradation of performance by the thermal shock test.

Example 2

A thermistor device was fabricated as in Example 1 except that the buildup of non-metallic fines was 0.5% by weight of the metal particles, and 49% by volume of the high-molecular weight organic compound, 6% by volume of the low-molecular weight organic compound and 45% by volume of the non-metallic fine-covered metal powder were compounded. As compared with the device of Example 1, this thermistor device had a high content of metal particles and a low buildup of non-metallic fines relative to the metal particles. The device was similarly tested.

The initial resistance at room temperature was $7.0\times10^{-3}\Omega$ (resistivity $5.7\times10^{-2}$ Ω-cm). The resistance marked a sharp rise at a temperature near 90° C., with the resistance change being of about 11 orders of magnitude. These demonstrated a low room-temperature resistance and a high resistance change rate. With respect to variations of initial resistance at room temperature, of ten samples, nine samples had a resistance of $7.0\times10^{-3}\Omega$, and one sample $8.0\times10^{-3}\Omega$, indicating a minimal variation.

After a hot humid storage test of holding at 60° C. and RH 95% for 1,000 hours, the device had a room-temperature resistance of $7.0\times10^{-3}\Omega$, indicating no degradation of performance during the hot humid storage. With respect to variations of initial room-temperature resistance after 1,000 hours of storage, of ten samples, eight samples had a resistance of $7.0\times10^{-3}\Omega$, and two samples $6.0\times10^{-3}\Omega$, indicating substantially no increase of variation during the hot humid storage.

The initial resistance at room temperature after the thermal shock test was $6.0\times10^{-3}\Omega$, indicating no degradation of performance by the thermal shock test.

The minimized variation of room-temperature resistance in this Example demonstrates that metal particles, even when loaded in a larger amount, are uniformly dispersed in the matrix by virtue of the coverage of metal particles with non-metallic fines.

Example 3

A thermistor device was fabricated as in Example 1 except that the buildup of non-metallic fines was 1.0% by weight of the metal particles, and 49% by volume of the high-molecular weight organic compound, 6% by volume of the low-molecular weight organic compound and 45% by volume of the non-metallic fine-covered metal powder were compounded. As compared with the device of Example 1, this thermistor device had a high content of metal particles and a low buildup of non-metallic fines relative to the metal particles. The device was similarly tested.

The initial resistance at room temperature was $8.0\times10^{-3}\Omega$ (resistivity $6.5\times10^{-2}$ Ω-cm). The resistance marked a sharp rise at a temperature near 90° C., with the resistance change being of about 11 orders of magnitude. These demonstrated a low room-temperature resistance and a high resistance change rate. With respect to variations of initial resistance at room temperature, of ten samples, eight samples had a resistance of $8.0\times10^{-3}\Omega$, and two samples $9.0\times10^{-3}\Omega$, indicating a minimal variation.

After a hot humid storage test of holding at 60° C. and RH 95% for 1,000 hours, the device had a room-temperature resistance of $9.0\times10^{-3}\Omega$, indicating substantially no degradation of performance during the hot humid storage. With respect to variations of initial resistance at room temperature after 1,000 hours of storage, of ten samples, eight samples had a resistance of $9.0\times10^{-3}\Omega$, and two samples $1.0\times10^{-2}\Omega$, indicating substantially no increase of variation during the hot humid storage.

The initial room-temperature resistance after the thermal shock test was $7.0\times10^{-3}\Omega$, indicating no degradation of performance by the thermal shock test.

The minimized variation of room-temperature resistance in this Example demonstrates that metal particles, even when loaded in a larger amount, are uniformly dispersed in the matrix by virtue of the coverage of metal particles with non-metallic fines.

Comparative Example 2

An attempt was made to fabricate a thermistor device as in Examples 2 and 3 aside from using a powder of bare metal particles. Because the proportion of metal particles compounded was as high as 45% by volume and the metal particles are not coated with non-metallic fines, the metal particles were bulky relative to the matrix material and less wettable by the matrix material, which prevented the metal particles from being uniformly dispersed in the matrix material. The attempt to fabricate a device failed.

Example 4

A thermistor device was fabricated as in Example 1 except that the buildup of non-metallic fines was 0.5% by weight of the metal particles, and 65% by volume of the high-molecular weight organic compound and 35% by volume of the non-metallic fine-covered metal powder were compounded. As compared with the device of Example 1, this thermistor device had a low buildup of non-metallic fines relative to the metal particles and was free of the low-molecular weight organic compound. The device was similarly tested.

The initial resistance at room temperature was $6.0\times10^{-3}\Omega$ (resistivity $4.9\times10^{-2}$ Ω-cm). The resistance marked a sharp rise at a temperature near 100° C., with the resistance change being of about 10 orders of magnitude. These demonstrated a low room-temperature resistance and a high resistance change rate. With respect to variations of initial resistance at room temperature, of ten samples, eight samples had a resistance of $6.0\times10^{-3}\Omega$, and two samples $7.0\times10^{-3}\Omega$, indicating a minimal variation.

After a hot humid storage test of holding at 60° C. and RH 95% for 1,000 hours, the device had a room-temperature resistance of $7.0\times10^{-3}\Omega$, indicating substantially no degradation of performance during the hot humid storage. With respect to variations of initial resistance at room temperature after 1,000 hours of storage, of ten samples, eight samples had a resistance of $7.0\times10^{-3}\Omega$, and two samples $9.0\times10^{-3}\Omega$, indicating substantially no increase of variation during the hot humid storage.

The initial room-temperature resistance after the thermal shock test was $8.0\times10^{-3}\Omega$, indicating substantially no degradation of performance by the thermal shock test.

As is evident from these results, the invention is beneficial even when the low-molecular weight organic compound is not included in the matrix.

Comparative Example 3

A thermistor device was fabricated as in Example 4 aside from using a powder of bare metal particles. The device was similarly tested.

The initial resistance at room temperature was $1.5\times10^{-3}\Omega$ (resistivity $1.2\times10^{-2}$ Ω-cm). The resistance marked a sharp rise at a temperature near 100° C., with the resistance change being of about 10 orders of magnitude. These demonstrated a low room-temperature resistance and a high resistance change rate.

With respect to variations of initial resistance at room temperature, of ten samples, three samples had a resistance of $1.0\times10^{-3}\Omega$, two samples $3.0\times10^{-3}\Omega$, four samples $5.0\times10^{-3}\Omega$, and one sample $1.0\times10^{-2}\Omega$, indicating a larger variation than in Example 4.

After a hot humid storage test of holding at 60° C. and RH 95% for 1,000 hours, the device had a resistance at room temperature of $2.5\times10^{-2}\Omega$, indicating noticeable degradation of performance during the hot humid storage. With respect to variations of initial resistance at room temperature after 1,000 hours of storage, of ten samples, five samples had a resistance of $2.5\times10^{-2}\Omega$, one sample $3.0\times10^{-2}\Omega$, three samples $1.5\times10^{-2}\Omega$, and one sample $1.0\times10^{-2}\Omega$, indicating an increase of variation during the hot humid storage.

The initial room-temperature resistance after the thermal shock test was $2.5\times10^{-1}\Omega$, indicating noticeable degradation of room-temperature resistance by the thermal shock test.

All the results of Examples and Comparative Examples attest the effectiveness of the present invention.

Japanese Patent Application No. 2002-150220 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. An organic positive temperature coefficient thermistor comprising a thermistor body comprising a high-molecular weight organic compound-containing matrix and metal particles, wherein a non-metallic powder of conductive non-metallic fines having an average particle diameter of 2 to 50 nm attaches to surfaces of the metal particles, and wherein said non-metallic powder of conductive non-metallic fines forms a layer having a thickness in the range of 0.1 to 100 nm on said surfaces of the metal particles.

2. The thermistor of claim 1 wherein the non-metallic powder is present in a range of 0.1 to 10% by weight based on the weight of the entire metal particles.

3. The thermistor of claim 1 wherein the non-metallic powder is carbon black.

4. The thermistor of claim 1 wherein said metal particles have spiky protuberances.

5. The thermistor of claim 1 wherein said thickness is in the range of 1 to 50 nm.

6. The thermistor of claim 1 wherein said non-metallic powder of conductive non-metallic fines cover the entire surface of each metal particle.

7. The thermistor of claim 1 wherein said non-metallic powder of conductive non-metallic fines attaches to said surfaces of the metal particles by an adhesive layer formed on said surfaces whereby said non-metallic fines are affixed thereto.

8. The thermistor of claim 7 wherein said adhesive layer comprises an organosilane compound.

9. The thermistor of claim 8 wherein said organosilane compound is obtained from an alkoxysilane solution.

10. The thermistor of claim 2 wherein the non-metallic powder is present in a range of 0.1 to 5% by weight based on the weight of the entire metal particles.

11. The thermistor of claim 1 wherein said average particle diameter is 2 to 35 nm.

12. The thermistor of claim 1 wherein said metal particles contain primary particles having an average particle diameter of at least 0.1 $\mu$m.

13. An organic positive temperature coefficient thermistor comprising a thermistor body comprising a high-molecular weight organic compound-containing matrix and metal particles, wherein a non-metallic powder of conductive non-metallic fines covers surfaces of the metal particles, and wherein said non-metallic powder of conductive non-metallic fines forms a layer having a thickness in the range of 0.1 to 100 nm on said surfaces of metal particles.

14. The thermistor of claim 13 wherein the non-metallic powder is present in range of 0.1 to 10% by weight based on the weight of the entire metal particles.

15. The thermistor of claim 13 wherein the non-metallic powder is carbon black.

16. The thermistor of claim 13 wherein said metal particles have spiky protuberances.

17. The thermistor of claim 13 wherein said thickness is in the range of 1 to 50 nm.

18. The thermistor of claim 13 wherein said non-metallic powder of conductive non-metallic fines cover the entire surface of each metal particle.

19. The thermistor of claim 13 wherein said non-metallic powder of conductive non-metallic fines cover said surfaces of the metal particles by an adhesive layer formed on said surfaces whereby said non-metallic fines are affixed thereto.

20. The thermistor of claim 19 wherein said adhesive layer comprises an organosilane compound.

21. The thermistor of claim 20 wherein said organosilane compound is obtained from an alkoxysilane solution.

22. The thermistor of claim 14 wherein the non-metallic powder is present in a range of 0.1 to 5% by weight based on the weight of the entire metal particles.

23. The thermistor of claim 13 wherein said metal particles contain primary particles having an average particle diameter of at least 0.1 $\mu$m.

* * * * *